US006932260B1

(12) United States Patent
Chou

(10) Patent No.: US 6,932,260 B1
(45) Date of Patent: Aug. 23, 2005

(54) NAILER HAVING POSITIONING EFFECT

(75) Inventor: Chien-Chi Chou, Pitou Hsiang (TW)

(73) Assignee: Yong Song Hardware & Tool Co., Ltd., Pitou Hsiang (TW)

( * ) Notice: Subject to any disclaimer, the term of this patent is extended or adjusted under 35 U.S.C. 154(b) by 0 days.

(21) Appl. No.: 10/874,013

(22) Filed: Jun. 22, 2004

(51) Int. Cl.[7] ..... B25C 7/00
(52) U.S. Cl. ..... 227/18; 227/16; 227/120; 227/138
(58) Field of Search ..... 227/16, 18, 120, 227/138; 221/197, 198, 297; 206/303, 445

(56) References Cited

U.S. PATENT DOCUMENTS 5,791,546 A * 8/1998 McGuinness et al. ..... 227/120
6,273,315 B1 * 8/2001 McGuinness et al. ..... 227/18
6,302,310 B1 * 10/2001 Lamb ..... 227/119
6,471,107 B2 * 10/2002 Liu et al. ..... 227/18
6,478,209 B1 * 11/2002 Bruins et al. ..... 227/16
6,481,610 B1 * 11/2002 Liu et al. ..... 227/18
6,543,666 B1 * 4/2003 Huang ..... 227/18
6,659,326 B2 * 12/2003 Huang ..... 227/18

* cited by examiner

*Primary Examiner*—Rinaldi I. Rada
*Assistant Examiner*—Nathaniel Chukwurah
(74) *Attorney, Agent, or Firm*—Alan D. Kamrath; Nikolai & Mersereau, P.A.

(57) ABSTRACT

A nailer includes a gun body, a magazine, a feed plate, a washer barrel, a catch plate, and a locking ring. Thus, the washer is closely positioned between the catch flange of the feed plate and the locking ring, thereby facilitating a user combining the washer with the nail. In addition, the locking ring is tensioned only when the washer passes through the locking ring, so that the locking ring is not maintained at the tightened state constantly, thereby preventing the locking ring from producing fatigue, and thereby enhancing the lifetime of the locking ring. Further, the locking ring is used to stop washers made of plastic or metallic material, thereby enhancing the versatility of the nailer.

13 Claims, 6 Drawing Sheets

NAILER HAVING POSITIONING EFFECT

BACKGROUND OF THE INVENTION

1. Field of the Invention

The present invention relates to a nailer, and more particularly to a nailer having a positioning effect to position a washer efficiently.

2. Description of the Related Art

A conventional nailer in accordance with the prior art shown in FIGS. 6–8 comprises a gun body 20, a magazine 21 mounted on the gun body 20 and containing a plurality of nails (not shown) which are ejected outward by the gun body 20, a feed plate 22 mounted on the gun body 20 and having a first end provided with a propeller 221 having an end provided with a push bar 222 and a second end formed with a through hole 223, a washer barrel 26 mounted on the gun body 20 and containing therein a plurality of washers 1 (see FIG. 8) made of plastic or metallic material, a catch plate 25 mounted on the feed plate 22 and having a top formed with an elongated slideway 251 having an end formed with a through bore 252 facing the through hole 223 of the feed plate 22 and having a side formed with a recess 253 for mounting a spring 24, and an elastic locking plate 23 having a first end secured on a side of the slideway 251 of the catch plate 25 and a second end formed with a locking portion 232 rested on the spring 24.

In operation, when one of the washers 1 is pushed by the push bar 222 of the propeller 221 of the feed plate 22 to move in the slideway 251 of the catch plate 25 to reach the position of the through bore 252 of the catch plate 25, the washer 1 is retained by the locking portion 232 of the locking plate 23. After the nail in the magazine 21 is ejected outward by the gun body 20, the nail passes through the washer 1 to carry the washer 1 to move downward, so that the washer 1 and the nail are ejected outward from the through bore 252 of the catch plate 25.

However, the locking plate 23 easily produces elastic fatigue during a long-term utilization, thereby decreasing the positioning effect of the locking plate 23, and thereby decreasing the lifetime of the locking plate 23.

Another conventional nailer in accordance with the prior art shown in FIG. 9 comprises a gun body (not shown), a magazine 31 mounted on the gun body and containing a plurality of nails (not shown) which are ejected outward by the gun body, a feed plate 32 mounted on the gun body and formed with a slideway 321, a washer barrel 34 mounted on the gun body and containing therein a plurality of washers 1A made of plastic material, and a catch plate 33 mounted on the feed plate 32 and formed with a through hole 331 facing the slideway 321 of the feed plate 32.

In operation, when one of the washers 1A is pushed by the feed plate 32 to move in the slideway 321 of the feed plate 32 to reach the position of the through hole 331 of the catch plate 33, the through hole 331 of the catch plate 33 is slightly smaller than the washer 1A, so that the washer 1A is retained by the through hole 331 of the catch plate 33. After the nail in the magazine 31 is ejected outward by the gun body, the nail passes through the washer 1A to carry the washer 1A to move downward. At this time, the washer 1A is deformed by the impact applied by the nail so as to pass through the through hole 331 of the catch plate 33, so that the washer 1A and the nail are ejected outward from the through hole 331 of the catch plate 33.

However, the washer 1A is deformed by its flexibility so as to pass through the through hole 331 of the catch plate 33, so that such a conventional nailer is only available for washers made of plastic material and is not available for washers made of metallic material, thereby limiting the versatility of the conventional nailer.

SUMMARY OF THE INVENTION

In accordance with the present invention, there is provided a nailer, comprising:

- a gun body;
- a magazine mounted on the gun body;
- a feed plate mounted on the gun body and connected to the magazine, the feed plate having an inside formed with an elongated slideway having a periphery formed with an inward extended catch flange rested on the at least one washer;
- a washer barrel mounted on the gun body and connected to the magazine and the feed plate, the washer barrel containing at least one washer;
- a catch plate mounted on the feed plate and having an end formed with a through hole facing the catch flange of the feed plate, the through hole of the catch plate having a periphery formed with an annular groove; and
- a locking ring received in the annular groove of the through hole of the catch plate and rested on the at least one washer, so that the at least one washer is located between the catch flange of the feed plate and the locking ring.

The primary objective of the present invention is to provide a nailer having a positioning effect to position a washer efficiently.

Another objective of the present invention is to provide a nailer, wherein the washer is positioned between the catch flange of the feed plate and the locking ring rigidly and stably, thereby facilitating a user combining the washer with the nail.

A further objective of the present invention is to provide a nailer, wherein the locking ring is tensioned only when the washer passes through the locking ring, so that the locking ring is not maintained at the tightened state constantly, thereby preventing the locking ring from producing fatigue, and thereby enhancing the lifetime of the locking ring.

A further objective of the present invention is to provide a nailer, wherein the locking ring is used to stop washers made of plastic or metallic material, thereby enhancing the versatility of the nailer.

Further benefits and advantages of the present invention will become apparent after a careful reading of the detailed description with appropriate reference to the accompanying drawings.

DETAILED DESCRIPTION OF THE INVENTION

Figure 1:
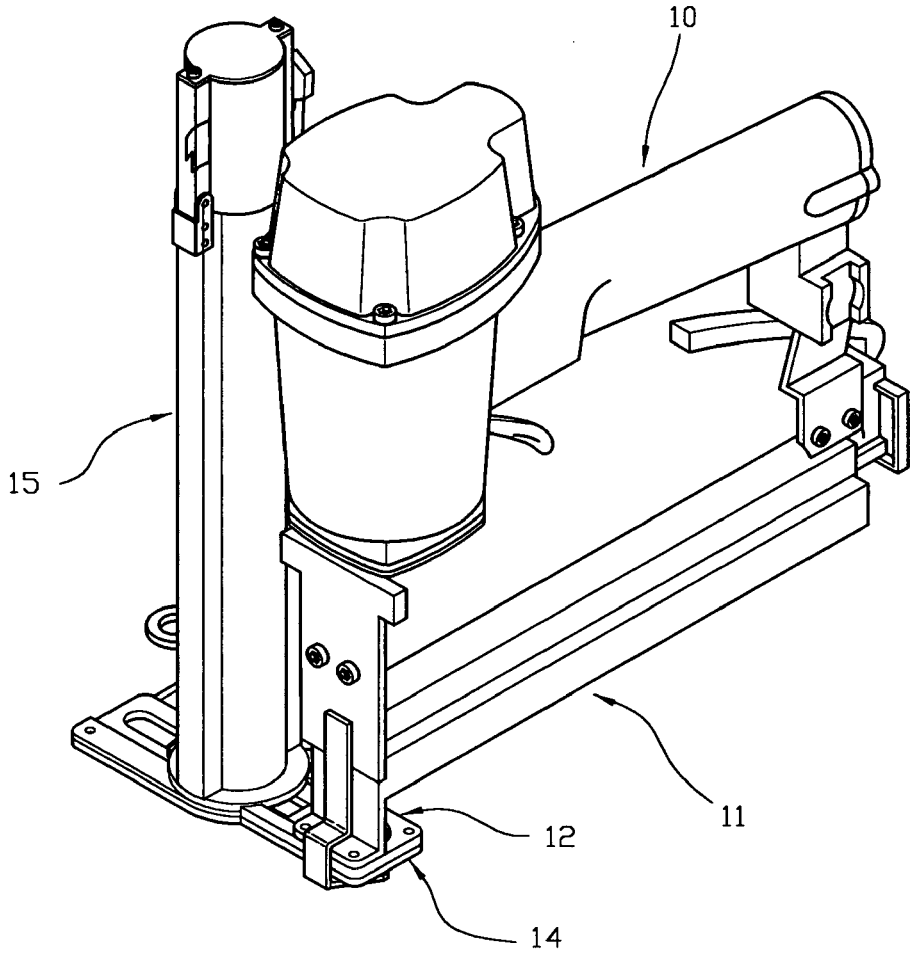
FIG. 1 is a perspective view of a nailer in accordance with the preferred embodiment of the present invention.

Referring to the drawings and initially to FIGS. 1–4, a nailer in accordance with the preferred embodiment of the present invention comprises a gun body 10, a magazine 11, a feed plate 12, a washer barrel 15, a catch plate 14, and a locking ring 13.

The magazine 11 is mounted on the gun body 10 and contains a plurality of nails (not shown) therein. The nails in the magazine 11 are ejected outward by the gun body 10.

The feed plate 12 is mounted on the gun body 10 and connected to the magazine 11. The feed plate 12 has a periphery provided with a propeller 121 having an end provided with a push bar 122. The feed plate 12 has an inside formed with an elongated slideway 123 having a periphery formed with an inward extended catch flange 124. Preferably, the slideway 123 is extended from a first end to a second end of the feed plate 12.

The washer barrel 15 containing a plurality of washers 100 (see FIG. 4) therein is mounted on the gun body 10 and connected to the magazine 11 and the feed plate 12.

The catch plate 14 is mounted on the feed plate 12 and has an end formed with a through hole 141 facing the catch flange 124 of the feed plate 12. The through hole 141 of the catch plate 14 has a periphery formed with an annular groove 142.

The locking ring 13 is mounted between the feed plate 12 and the catch plate 14 and received in the annular groove 142 of the through hole 141 of the catch plate 14. The locking ring 13 has a side formed with an opening 131, so that the locking ring 13 is substantially C-shaped and is made flexible. The locking ring 13 has a substantially circular cross-section.

Figure 4:
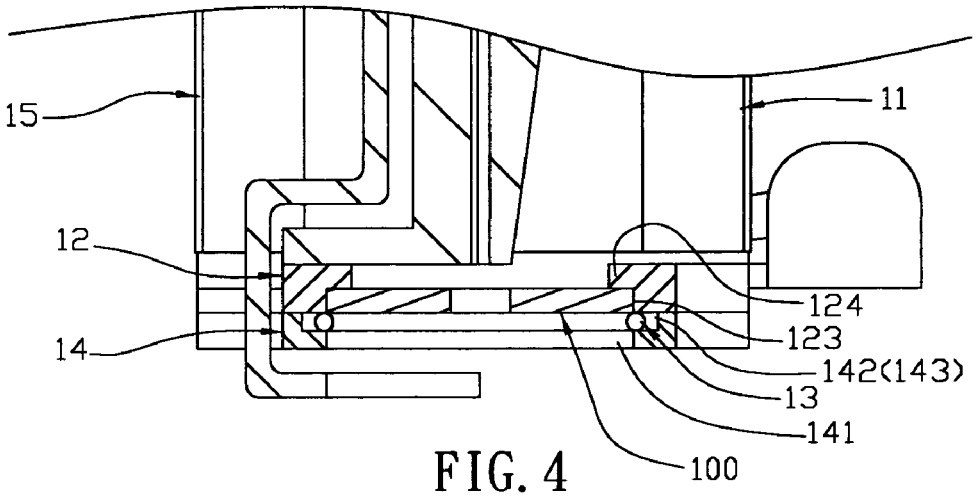
FIG. 4 is a partially side plan cross-sectional view of the nailer as shown in FIG. 1.

The locking ring 13 has an outer diameter greater than a width of the slideway 123 of the feed plate 12, so that the locking ring 13 is rested on a wall of the slideway 123 of the feed plate 12 as shown in FIG. 4. The locking ring 13 has an inner diameter smaller than an outer diameter of each of the washers 100 as shown in FIG. 4.

The through hole 141 of the catch plate 14 has a diameter greater than the outer diameter of each of the washers 100 and smaller than the outer diameter of the locking ring 13, so that the locking ring 13 is rested on a wall of the through hole 141 of the catch plate 14 as shown in FIG. 4.

The annular groove 142 of the through hole 141 of the catch plate 14 has a diameter greater than the outer diameter of the locking ring 13, so that a movable space 143 (see FIG. 4) is defined between the locking ring 13 and a wall of the annular groove 142 of the through hole 141 of the catch plate 14. Thus, the locking ring 13 is retracted into the movable space 143 when the locking ring 13 is pressed outward.

Figure 3:
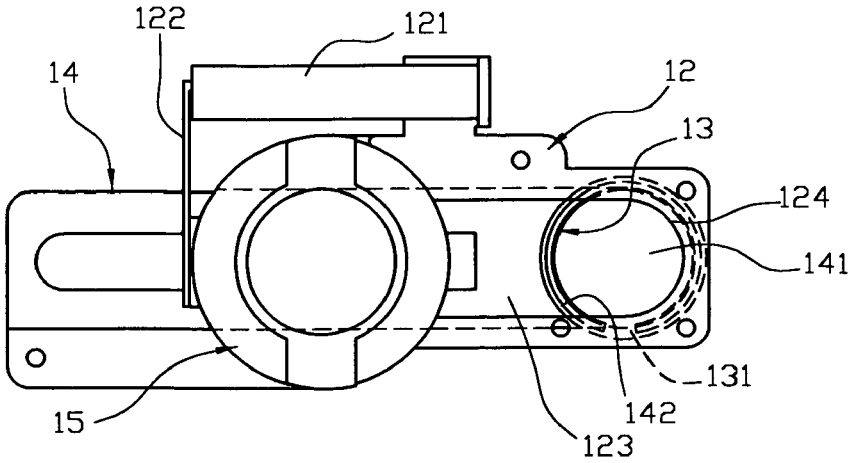
FIG. 3 is a partially top plan view of the nailer as shown in FIG. 1.
Figure 2:
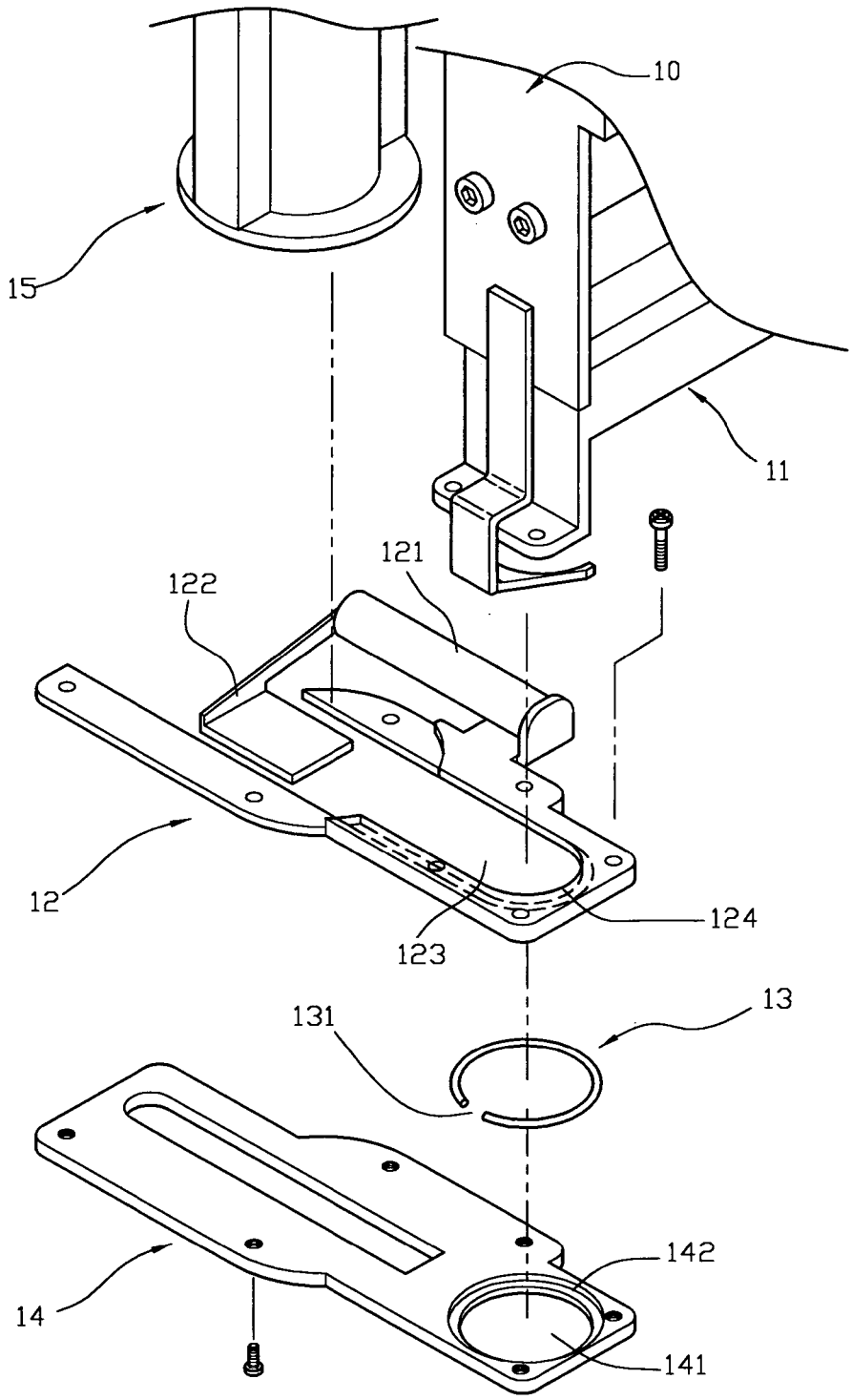
FIG. 2 is a partially exploded perspective view of the nailer as shown in FIG. 1.
Figure 5:
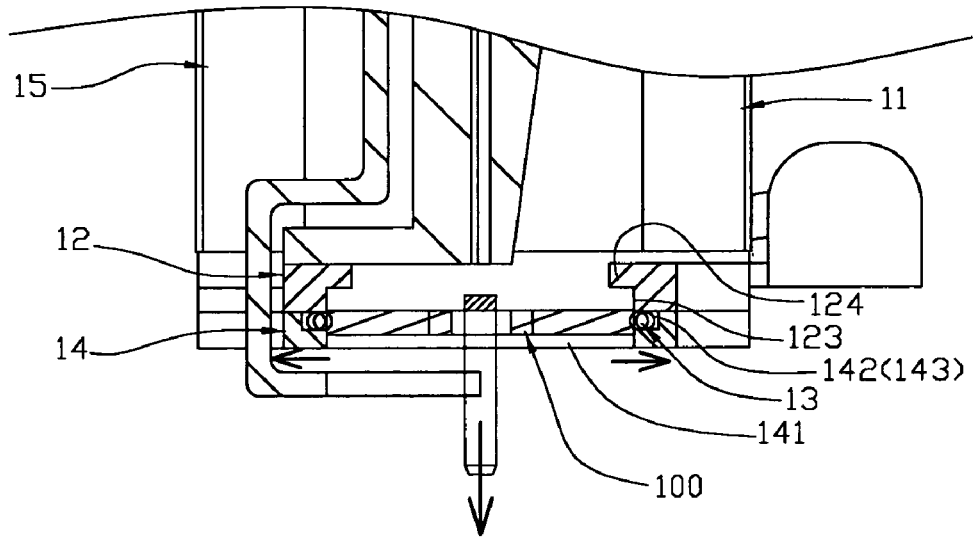
FIG. 5 is a schematic operational view of the nailer as shown in FIG. 4 in use.
Figure 6:
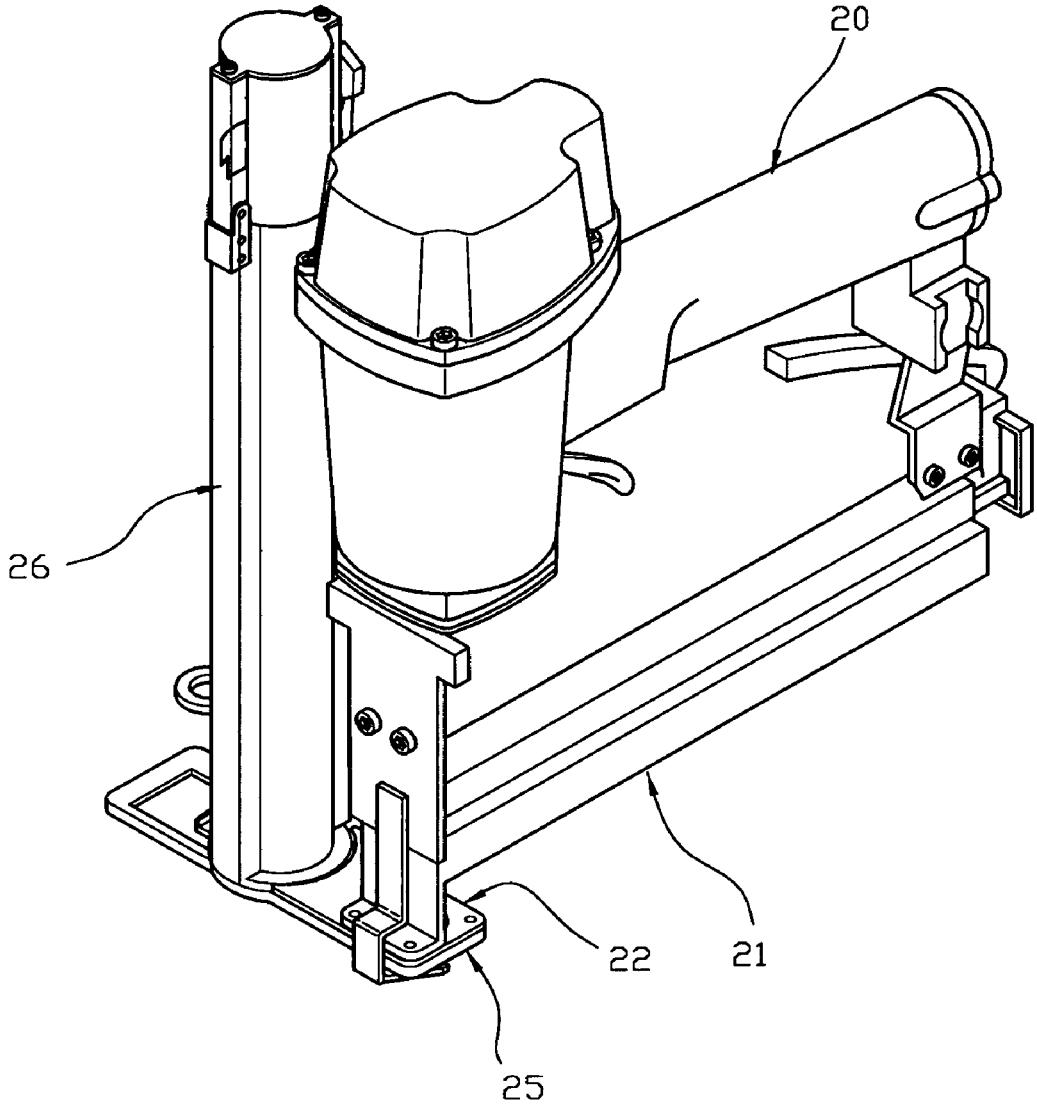
FIG. 6 PRIOR ART
FIG. 6 is a perspective view of a conventional nailer in accordance with the prior art.
Figure 7:
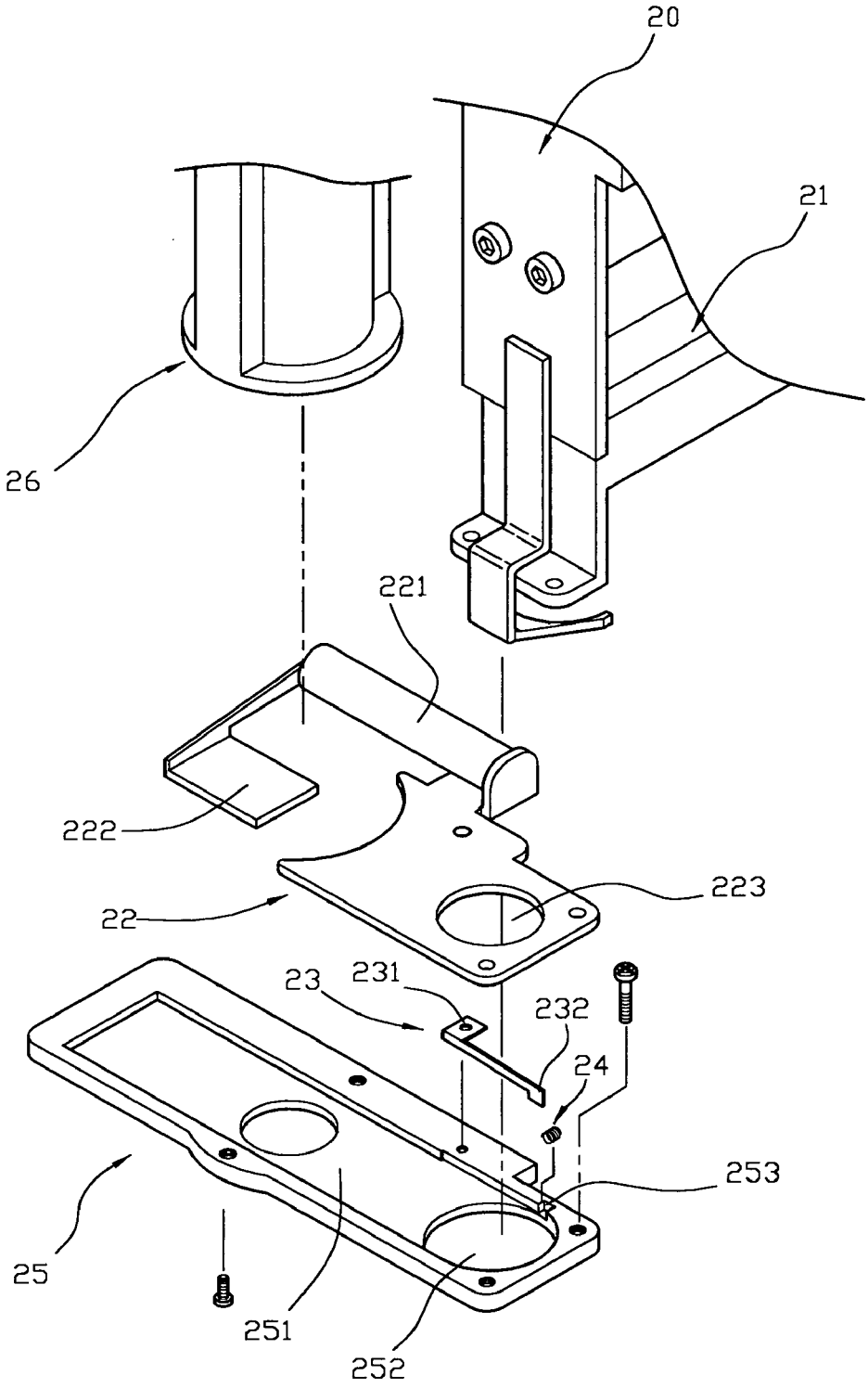
FIG. 7 PRIOR ART
FIG. 7 is a partially exploded perspective view of the conventional nailer as shown in FIG. 6.
Figure 8:
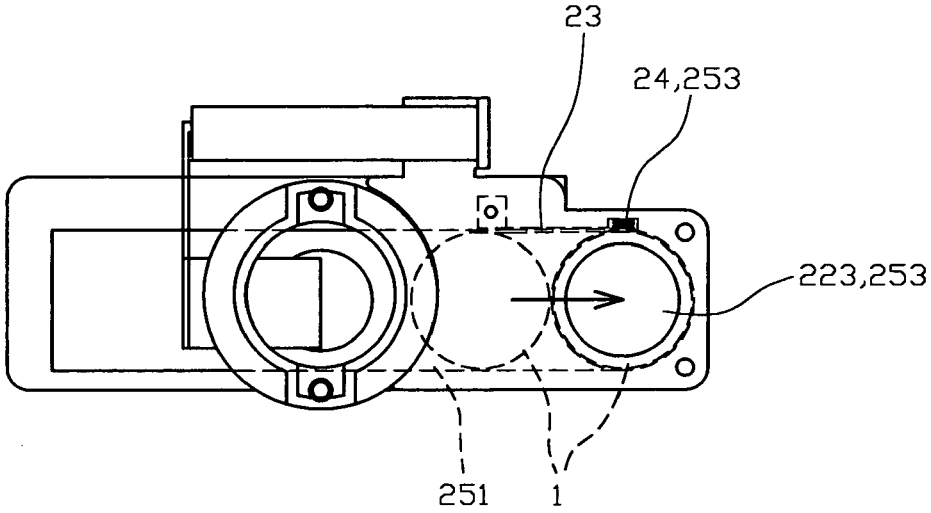
FIG. 8 PRIOR ART
FIG. 8 is a top plan view of the conventional nailer as shown in FIG. 6.
Figure 9:
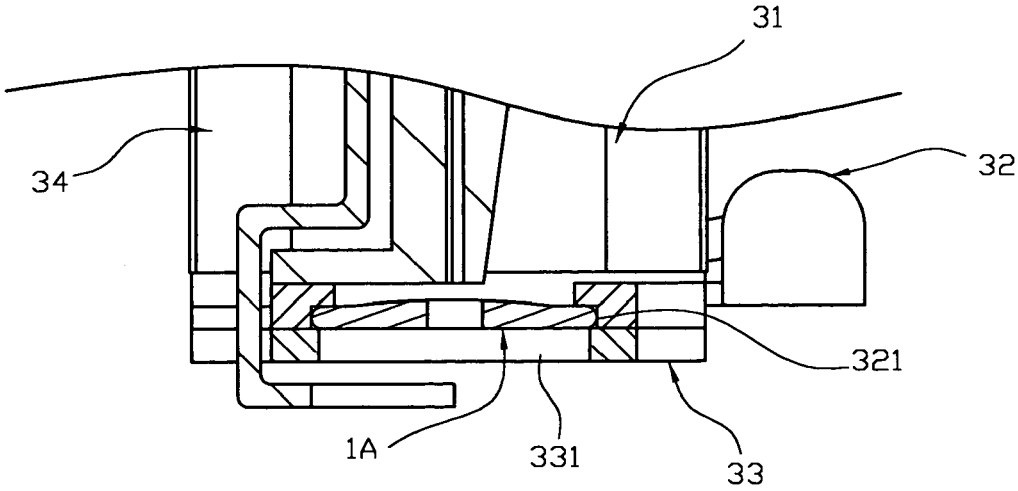
FIG. 9 PRIOR ART
FIG. 9 is a partially side plan cross-sectional assembly view of another conventional nailer in accordance with the prior art.

In operation, referring to FIGS. 4 and 5 with reference to FIGS. 1–3, when one of the washers 100 is pushed by the push bar 122 of the propeller 121 of the feed plate 12 to move in the slideway 123 of the feed plate 12 to reach the position of the locking ring 13 and the through hole 141 of the catch plate 14, the washer 100 is retained between the catch flange 124 of the feed plate 12 and the locking ring 13. At this time, the outer diameter of each of the washers 100 is greater than the outer diameter of the locking ring 13, so that the washer 100 is stopped by the locking ring 13 as shown in FIG. 4.

After the nail in the magazine 11 is ejected outward by the gun body 10, the nail passes through the washer 100 to carry the washer 100 to move downward simultaneously, so that the washer 100 produces a impact to press and expand the locking ring 13 outward due to the circular cross-section of the locking ring 13, thereby retracting the locking ring 13 into the movable space 143 as shown in FIG. 5. In such a manner, the locking ring 13 is deformed and expanded outward to form an elastic deformation, thereby allowing passage of the washer 100, so that the washer 100 passes through the locking ring 13 and the through hole 141 of the catch plate 14 easily and conveniently.

Accordingly, the washer 100 is positioned between the catch flange 124 of the feed plate 12 and the locking ring 13 rigidly and stably, thereby facilitating a user combining the washer 100 with the nail. In addition, the locking ring 13 is tensioned only when the washer 100 passes through the locking ring 13, so that the locking ring 13 is not maintained at the tightened state constantly, thereby preventing the locking ring 13 from producing fatigue, and thereby enhancing the lifetime of the locking ring 13. Further, the locking ring 13 is used to stop washers made of plastic or metallic material, thereby enhancing the versatility of the nailer.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A nailer, comprising:

a gun body;

a magazine mounted on the gun body;

a feed plate mounted on the gun body and connected to the magazine, the feed plate having an inside formed with an elongated slideway having a periphery formed with an inward extended catch flange rested on at least one washer;

a washer barrel mounted on the gun body and connected to the magazine and the feed plate, the washer barrel containing at least one washer;

a catch plate mounted on the feed plate and having an end formed with a through hole facing the catch flange of the feed plate, the through hole of the catch plate having a periphery formed with an annular groove; and a locking ring received in the annular groove of the through hole of the catch plate and rested on the at least one washer, so that the at least one washer is located between the catch flange of the feed plate and the locking ring.

2. The nailer in accordance with claim 1, wherein the locking ring has a side formed with an opening.

3. The nailer in accordance with claim 1, wherein the locking ring is substantially C-shaped.

4. The nailer in accordance with claim 1, wherein the locking ring is flexible.

5. The nailer in accordance with claim 1, wherein the locking ring has a substantially circular cross-section.

6. The nailer in accordance with claim 1, wherein the locking ring is mounted between the feed plate and the catch plate.

7. The nailer in accordance with claim 1, wherein the locking ring has an outer diameter greater than a width of the slideway of the feed plate, so that the locking ring is rested on a wall of the slideway of the feed plate.

8. The nailer in accordance with claim 1, wherein the locking ring has an inner diameter smaller than an outer diameter of the at least one washer.

9. The nailer in accordance with claim 1, wherein the through hole of the catch plate has a diameter greater than an outer diameter of the at least one washer.

10. The nailer in accordance with claim 1, wherein the through hole of the catch plate has a diameter smaller than an outer diameter of the locking ring, so that the locking ring is rested on a wall of the through hole of the catch plate.

11. The nailer in accordance with claim 1, wherein the annular groove of the through hole of the catch plate has a diameter greater than an outer diameter of the locking ring, so that a movable space is defined between the locking ring and a wall of the annular groove of the through hole of the catch plate.

12. The nailer in accordance with claim 11, wherein the locking ring is retracted into the movable space when the locking ring is pressed outward.

13. The nailer in accordance with claim 1, wherein the slideway is extended from a first end to a second end of the feed plate.

* * * * *